US011377240B2

(12) United States Patent
Spallino et al.

(10) Patent No.: US 11,377,240 B2
(45) Date of Patent: Jul. 5, 2022

(54) SELF-PROPELLED WRAPPING MACHINE

(71) Applicant: ROBOPAC S.P.A., Acquaviva-Gualdicciolo (SM)

(72) Inventors: Federico Spallino, Acquaviva-Gualdicciolo (SM); Paolo Pecchenini, Acquaviva-Gualdicciolo (SM)

(73) Assignee: ROBOPAC S.P.A., Acquaviva Gualdicciolo (SM)

( * ) Notice: Subject to any disclaimer, the term of this patent is extended or adjusted under 35 U.S.C. 154(b) by 0 days.

(21) Appl. No.: 17/259,277

(22) PCT Filed: Jul. 8, 2019

(86) PCT No.: PCT/IB2019/055794
§ 371 (c)(1),
(2) Date: Jan. 11, 2021

(87) PCT Pub. No.: WO2020/012327
PCT Pub. Date: Jan. 16, 2020

(65) Prior Publication Data

US 2021/0276743 A1 Sep. 9, 2021

(30) Foreign Application Priority Data

Jul. 11, 2018 (IT) ..... 102018000007119

(51) Int. Cl.
*B65B 11/14* (2006.01)
*B65B 11/02* (2006.01)

(52) U.S. Cl.
CPC ..... *B65B 11/025* (2013.01); *B65B 2210/14* (2013.01)

(58) Field of Classification Search
USPC ..... 53/588
See application file for complete search history.

(56) References Cited

U.S. PATENT DOCUMENTS 4,616,474 A 10/1986 Morley et al.
2007/0169442 A1* 7/2007 Asioli ..... B65B 11/025 53/588

(Continued)

FOREIGN PATENT DOCUMENTS

EP 3 070 003 9/2016
EP 3 214 001 9/2017

(Continued)

OTHER PUBLICATIONS

International Search Report dated Nov. 21, 2019 in International (PCT) Application No. PCT/IB2019/055794.

*Primary Examiner* — Chinyere J Rushing-Tucker
(74) *Attorney, Agent, or Firm* — Wenderoth, Lind & Ponack, L.L.P.

(57) ABSTRACT

A self-propelled wrapping machine movable around a load to wrap the load with a film of plastic material, comprises a wrapping apparatus, which includes a supporting base, a column fixed thereto and an unwinding unit slidably supported by the column and suitable to supply the film unwound from a reel; and an automatic guided vehicle movable and arranged to be reversibly and automatically coupled to the supporting base in an assembled condition of the self-propelled wrapping machine to support and move the wrapping apparatus around the load and enable to wrap the load with the film.

15 Claims, 4 Drawing Sheets

(56) References Cited

U.S. PATENT DOCUMENTS

| | | | | |
|---|---|---|---|---|
| 2014/0053502 | A1* | 2/2014 | Pecchenini | B65B 11/025 53/218 |
| 2014/0174027 | A1 | 6/2014 | Cere' et al. | |
| 2018/0111709 | A1 | 4/2018 | Cere' et al. | |
| 2018/0194503 | A1 | 7/2018 | Luo et al. | |
| 2019/0002138 | A1* | 1/2019 | Laghi | B65B 11/025 |

FOREIGN PATENT DOCUMENTS

| | | |
|---|---|---|
| EP | 3 450 329 | 3/2019 |
| JP | 2004-268955 | 9/2004 |
| WO | 2013/024426 | 2/2013 |

* cited by examiner

SELF-PROPELLED WRAPPING MACHINE

The invention relates to movable or self-propelled wrapping machines arranged to wrap a film of extensible plastic material around a load consisting in a product or a plurality of products arranged on a pallet such as to obtain a so-called palletized load.

Self-propelled wrapping machines, also called self-propelled wrapping robots, are machines employed to wrap loads of variable shapes and sizes and limited in number, typically in environments or places where fixed or static wrapping machines cannot be used due to the volumes and/or room availability. Loads are generally formed by pallets whereon a plurality of products and/or objects, also having different sizes and shapes, are arranged, more or less properly overlaid. In other cases the wrapping, normally for protection purposes, concerns directly the product, which generally has large size.

Self-propelled wrapping machines include a carriage or cart provided with powered rear wheels and with a front guide device comprising a pair of steering wheels generally guided by a steer. The steer can be actuated by means of a guiding bar or helm by an operator to manually drive the machine in a working configuration, or by a sensoring element capable of following the outer profile of the load in a working configuration, wherein the self-propelled machine rotates independently about the load to wrap it with the film. Alternatively, the steer is powered and controlled by means of sensors capable of detecting the presence and the volumes of the load in order to enable the machine to rotate about the latter at a predefined distance.

A vertical column, along which an unwinding or dispensing apparatus is movable which houses a plastic film reel and a plurality of rollers for unwinding and possibly pre-stretching the film, is fixed to the cart. More precisely, the unwinding apparatus can be provided with a pair of pre-stretching rollers arranged to unwind the film from the reel and pre-stretch or elongate it, and one or more return rollers to deviate the film towards the load.

The combination of the alternating linear movement of the unwinding apparatus along the vertical column and the rotation of the self-propelled machine around the load enables to wrap the film around the latter such as to form a series of helically intersected strips or bands. The plastic film is wrapped such as to wrap the load completely throughout its sides.

The known self-propelled wrapping machines, even in the simplest implementations, are however expensive and require enormous investments, especially if more wrapping machines are needed to carry out wrapping operations for instance in a factory or in a warehouse.

An object of the present invention is to improve the known self-propelled wrapping machines arranged to wrap a load with a plastic material film.

Another object is to implement a self-propelled wrapping machine that is particularly cost-effective, efficient and easy to use and that can be employed in a versatile and flexible way.

An additional object is to provide a self-propelled wrapping machine that makes it possible to substantially evenly and regularly wrap the film around loads also having different sizes and composition.

Such and other objects are achieved by a self-propelled wrapping machine according to one or more of the hereinafter reported claims.

The invention will be better understood and implemented referring to the enclosed drawings which illustrate some exemplary and non-limiting embodiments, wherein.

Figures 1, 2:
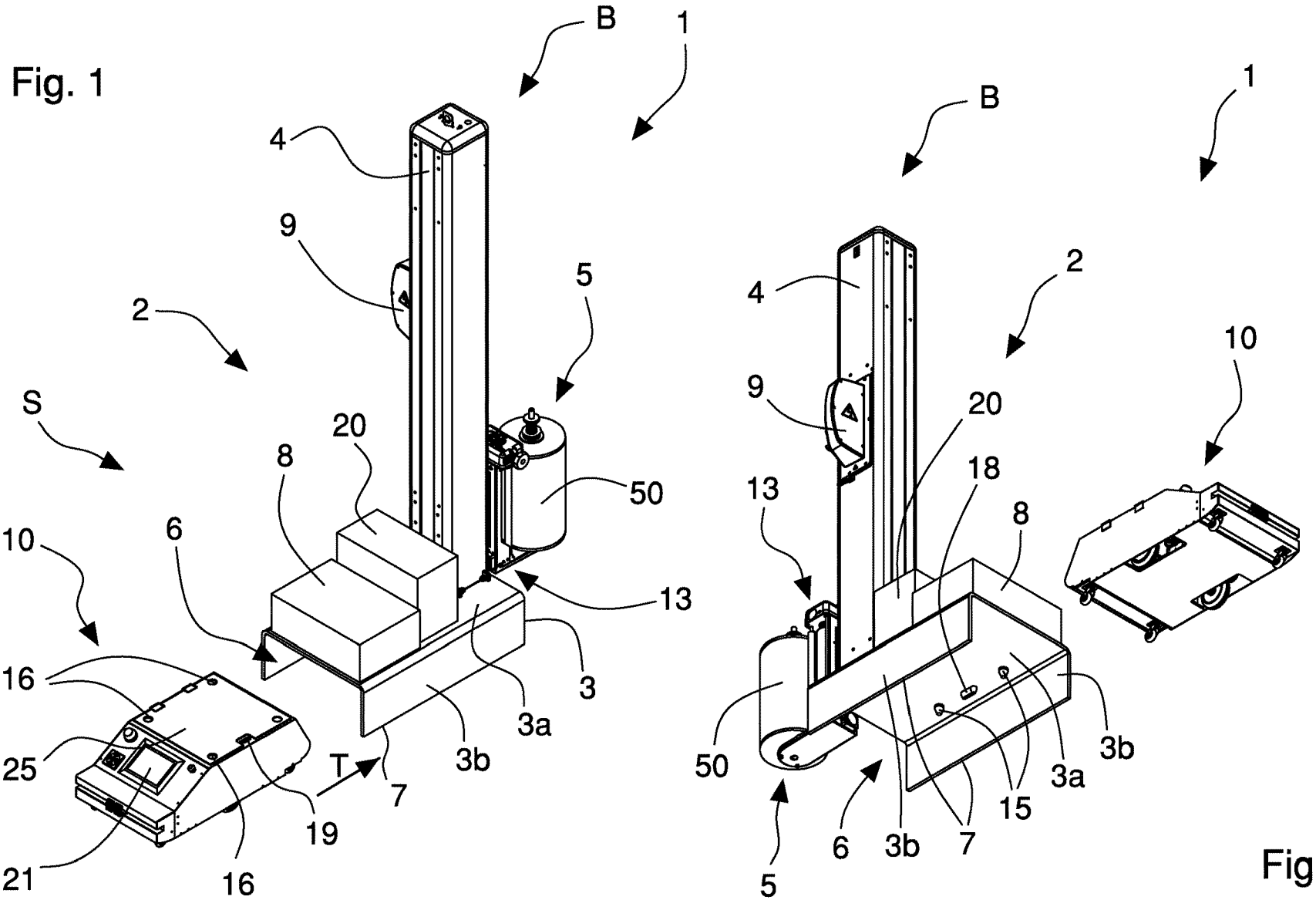
FIG. 1 is a perspective view from above of the self-propelled wrapping machine of the invention in a disassembled configuration where a wrapping apparatus and an automatic guided vehicle are disjointed and separated.
FIG. 2 is a perspective view from below of the machine of FIG. 1.
Figure 4:
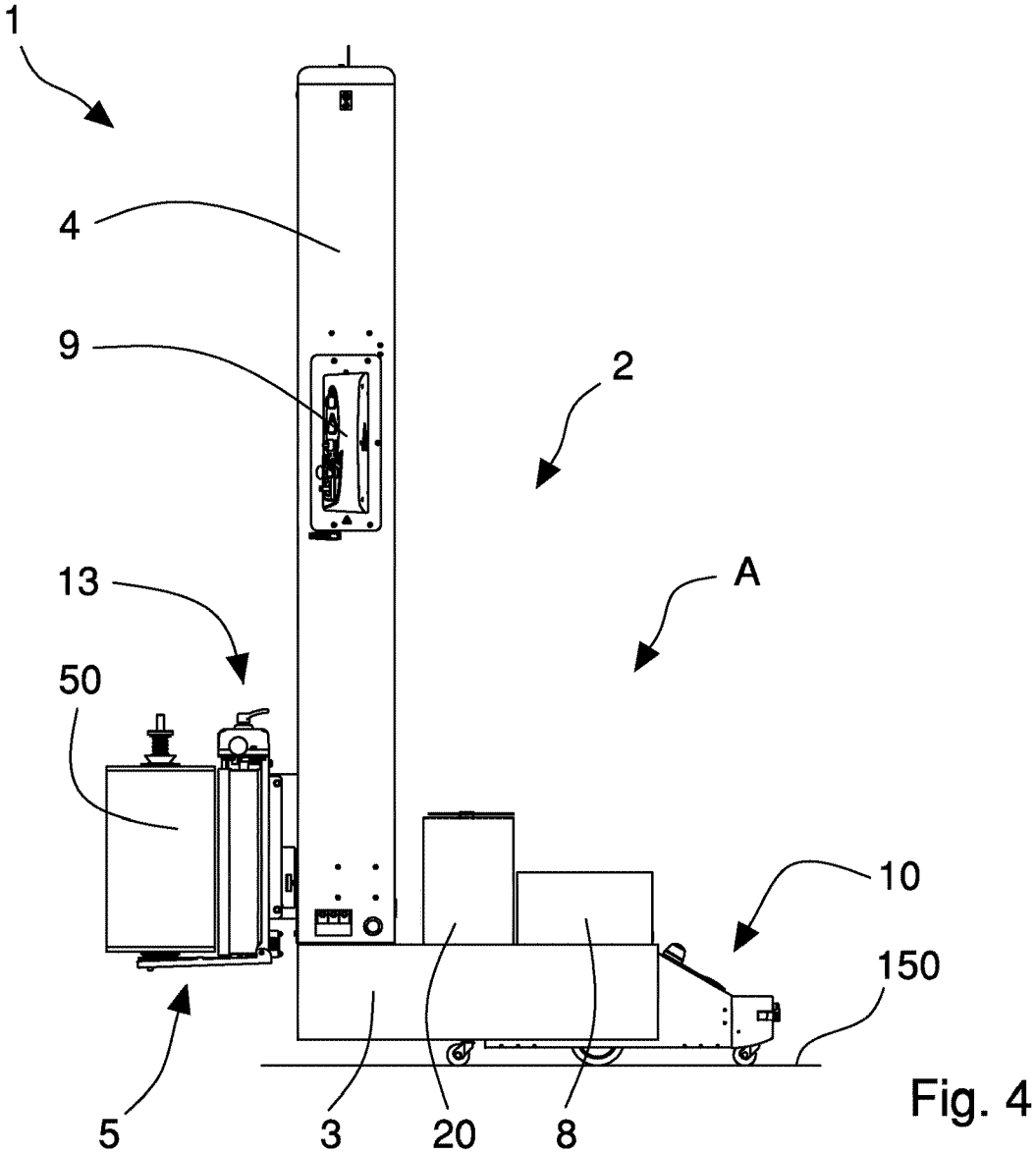
FIG. 4 is a side view of the machine of FIG. 3.
Figure 3:
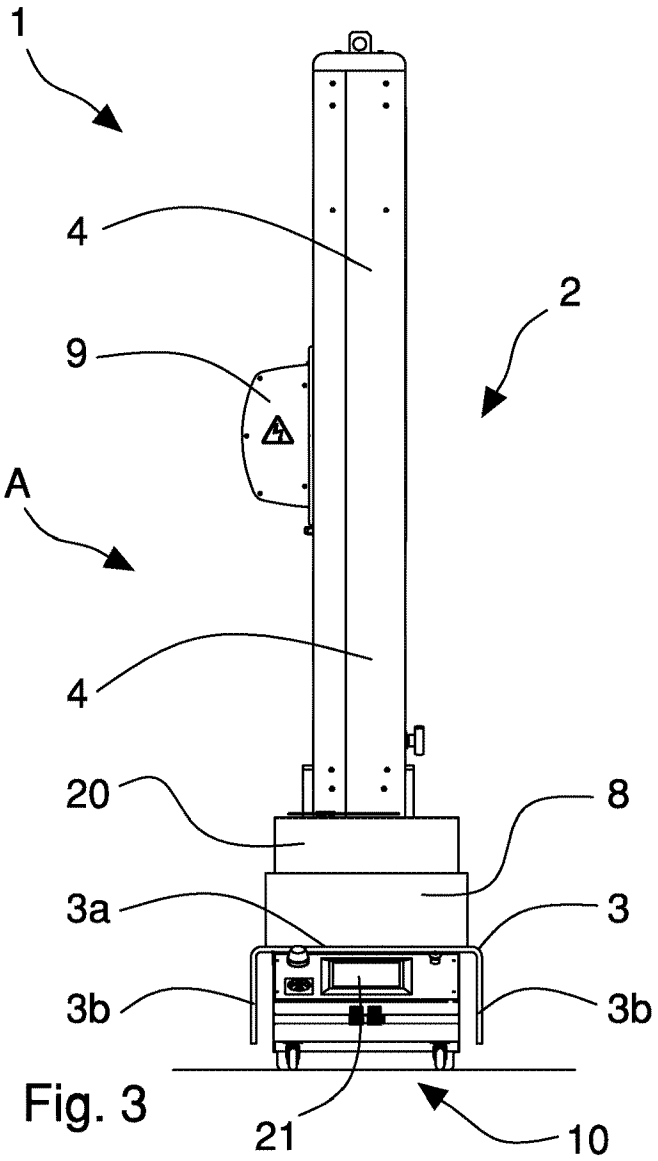
FIG. 3 is a front view of the self-propelled wrapping machine of FIG. 1 in an assembled condition where the wrapping apparatus and the automatic guided vehicle are coupled.
Figure 6:
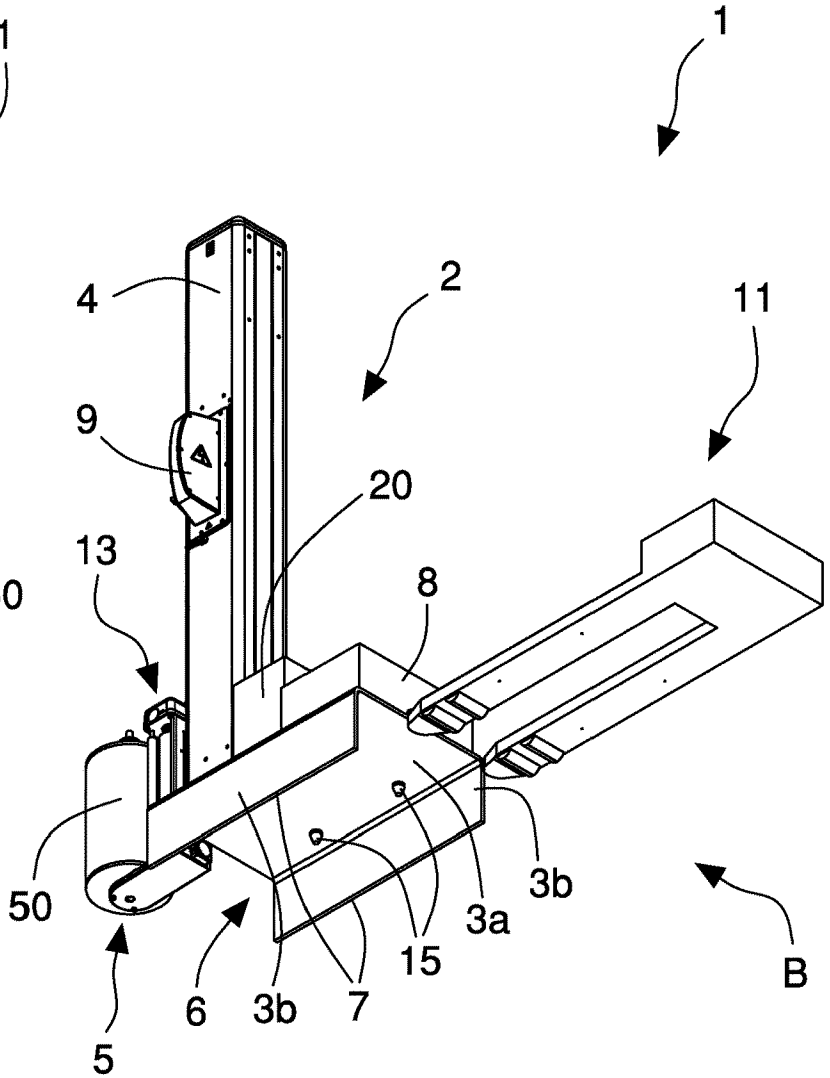
FIG. 6 is a perspective view from below of the machine of FIG. 5.
Figure 5:
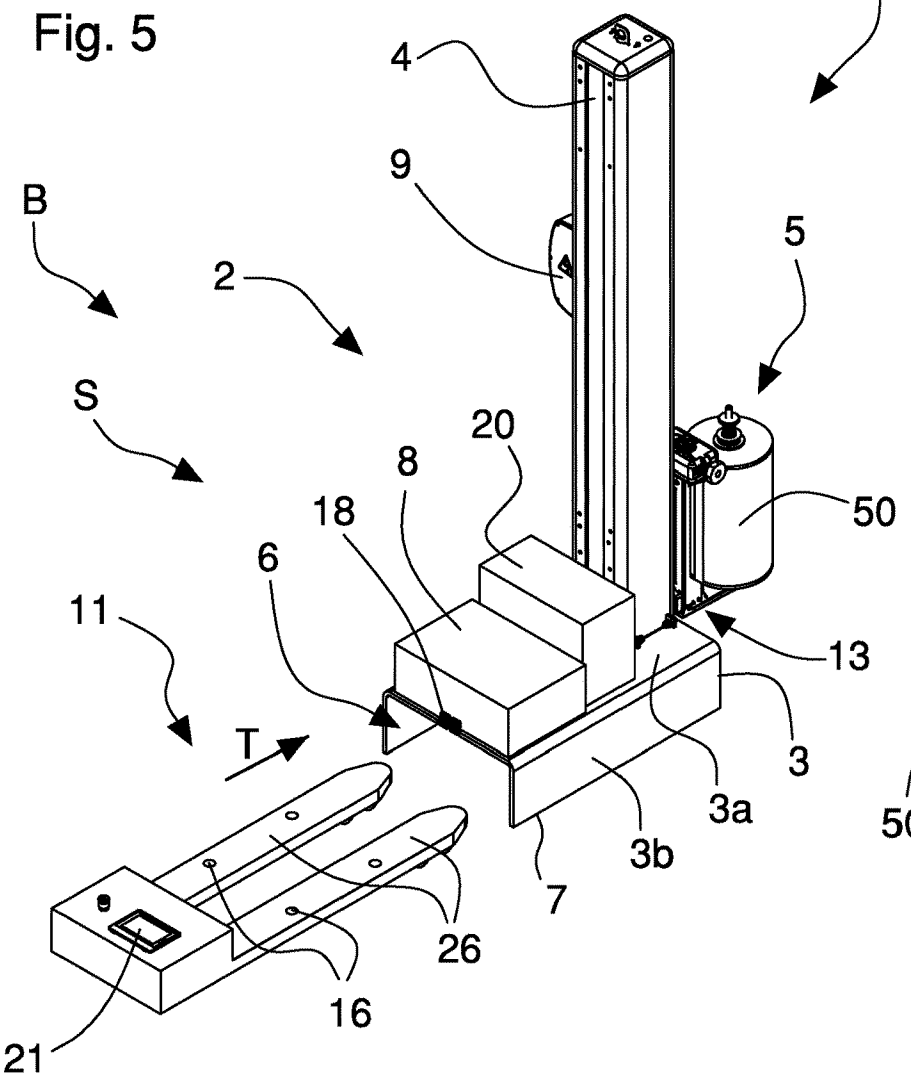
FIG. 5 is a perspective view from above of a variant of the self-propelled wrapping machine of the invention in the disassembled condition.
Figure 8:
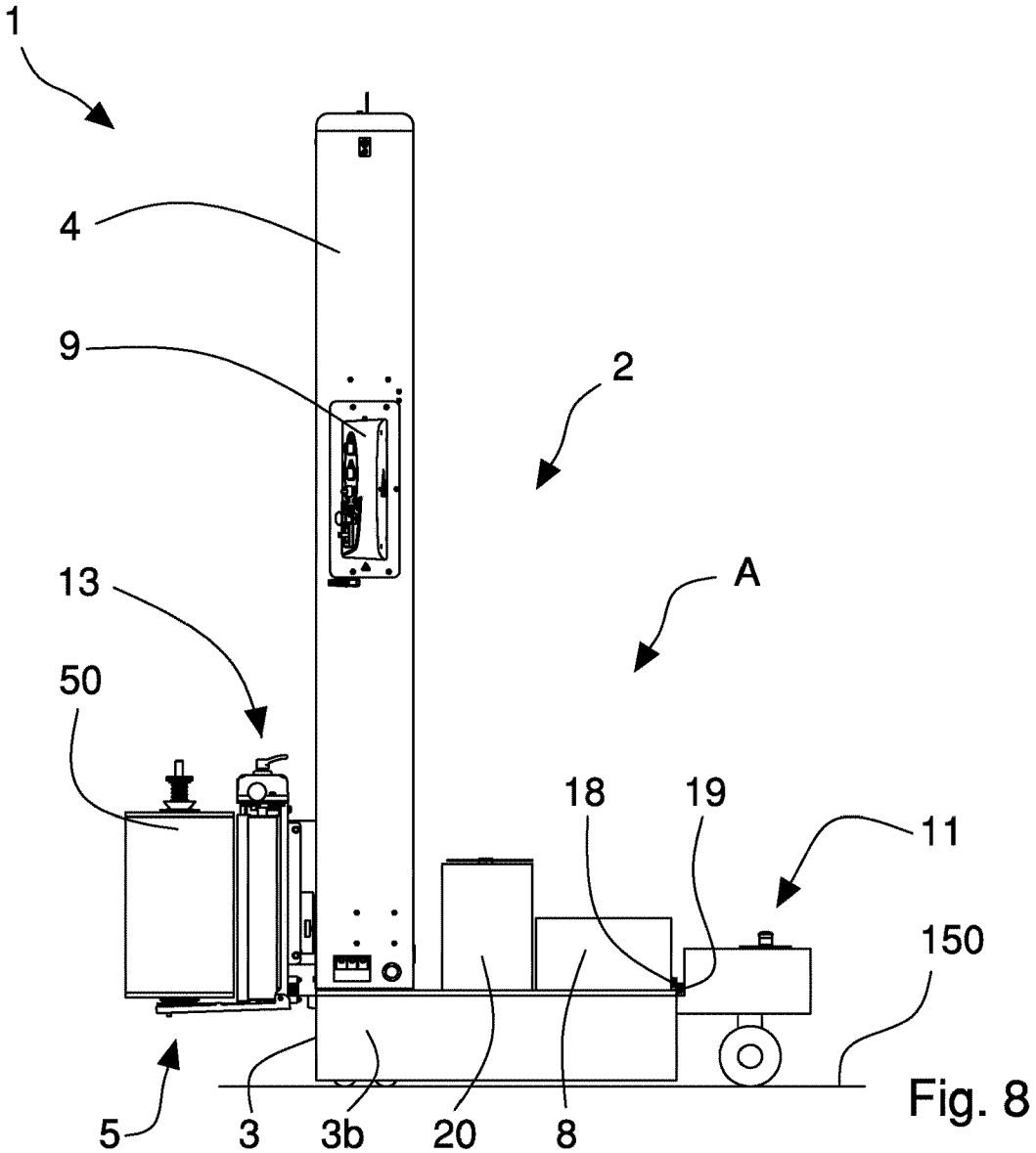
FIG. 8 is a side view of the machine of FIG. 7.
Figure 7:
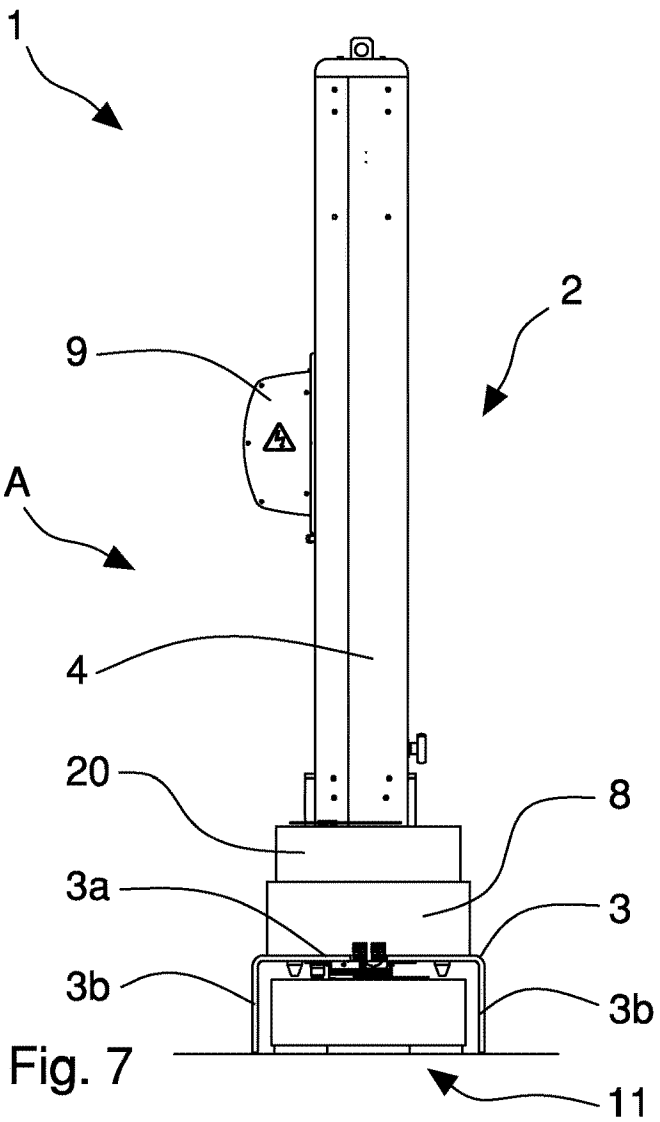
FIG. 7 is a front view of the self-propelled wrapping machine of FIG. 5 in the assembled configuration.

Referring to FIGS. 1 to 4, it is shown a self-propelled wrapping machine 1 according to the invention, that is movable around a load to wrap the latter with a film of plastic material unwound from a reel.

The self-propelled wrapping machine 1 comprises a wrapping apparatus 2 which includes a supporting base 3, a column 4 fixed thereto and an unwinding unit 5 slidably supported by the column 4 and adapted to supply the film unwound from a reel 50. The self-propelled wrapping machine 1 also comprises an automatic or autonomously guided shuttle or vehicle 10 movable and arranged to be reversibly and automatically coupled, i.e. with no intervention by operator, to the supporting base 3 in an assembled condition A of the aforesaid self-propelled wrapping machine 1, so as to support and move the wrapping apparatus 2 around the load and to enable wrapping the latter with the film. The automatic guided vehicle 10 is also arranged to automatically, in particular reversibly, uncouple from the supporting base 3 in a disassembled condition B of the self-propelled wrapping machine 1, in which the automatic guided vehicle 10 and the wrapping apparatus 2 are uncoupled and separated.

As known, automated or automatic guided vehicles, so called AGVs, are vehicles or shuttles capable of moving autonomously with no operator required and are widely employed in the industrial sector to move carriages, pallets, products, parts, pieces, etcetera within a factory premise, plant, warehouse. These vehicles are provided with guiding systems that make it possible to automatically move them along preset paths. Automatic guided vehicles can have different shapes, size, structure and function.

The supporting base comprises a seating or housing 6 configured to receive, at least partially, the automatic guided vehicle 10 or vehicle 10 for the sake of brevity, in the assembled condition A. More precisely, the vehicle 10 is configured to be automatically inserted into, or removed from, the seating 6 moving along an operating direction T, in particular of insertion/removal, nearly parallel to a supporting plane 150 on which the vehicle 10 rests and moves, typically the supporting plane 150 of the room or place where the wrapping machine 1 and the vehicle 10 operate.

In the disassembled condition B of the wrapping machine 1 the wrapping apparatus 2 lies on the supporting plane 150. To this end, the supporting base 3 is provided with a supporting arrangement 7 arranged to abut the supporting plane 150 and to support the entire wrapping apparatus 2 (FIGS. 1 and 2).

Alternatively, in a variant of the wrapping machine 1 not shown in the figures, the supporting base 3 may not be provided with a supporting arrangement 7 and may be supported in the disassembled configuration B by specific and separate side supports which rest on the supporting plane 150 and thus keep the entire wrapping apparatus 2 lifted therefrom.

In the exemplary and non-limiting illustrated embodiment, the supporting base 3 comprises a "C"-section element, for instance obtained by folding a metal sheet, in which two opposite side edges 3*b* connected by a central portion 3*a* form the two supports of the supporting arrangement 7. The central portion 3*a*, nearly horizontal and parallel to the supporting plane 150 and the side edges 3*b*, nearly vertical and orthogonal the supporting plane 150, form the seating 6 that houses, at least partially, the vehicle 10 in the assembled configuration A.

The vehicle 10 comprises a lifting system 25 which enables to lift the wrapping apparatus 2 from the supporting plane 150 to displace the wrapping apparatus 2.

In the illustrated embodiment, the vehicle 10 is a lowered or a "sole-shaped" automatic guided vehicle of the type used to tow carriages and the lifting system comprises a platform 25 placed at the top of the vehicle 10 and vertically movable such as to abut an inner wall of the central portion 3*a* of the supporting base 3 and hence to lift the latter and the whole wrapping apparatus 2 from the supporting plane 150.

Connecting assemblies 15, 16 are provided to restrain the wrapping apparatus 2 to the vehicle 10 in the assembled condition A. More precisely, the connecting assemblies comprise a first connecting assembly 15 associated with the supporting base 3 and a second connecting assembly 16 associated with the vehicle 10.

The first connecting assembly comprises, for example, a plurality of pins 15, for example four and cone-shaped, which extend from the inner wall of the central portion 3*a* of the supporting base 3 and are arranged to engage with respective openings 16 which form the second connecting assembly of the vehicle 10. The openings 16 are made on the lifting platform 25.

An interface system 18, 19 is provided to connect, in particular automatically, the wrapping apparatus 2 and the vehicle 10 in the assembled condition A and to allow transmitting electric signals and/or electric power supply. In particular, the interface system 18, 19 puts in communication one first control unit 20 of the wrapping apparatus 2 and one second control unit 21 of the vehicle 10. The first control unit 20, which is associated with an user interface 9 fixed on the column 4, is arranged to control and adjust at least the unwinding of the film around the load during a wrapping procedure.

The first control unit 20 comprises power actuations and control printed circuit boards of the known type. The second control unit 21 is arranged to control and guide the vehicle 10 at least around the load, along a predefined wrapping path during the wrapping procedure.

The first control unit 20 and the second control unit 21, connected and communicating one another by means of the interface system 18, 19, are arranged to control and guide the vehicle 10 along the wrapping path and to control the movement of the unwinding unit 5 along the column 4 and the unwinding of the film around the load so as to achieve a defined wrapping configuration F of the latter.

The interface system comprises, for instance, one first insert plug 18 provided on the supporting base 3 and arranged to couple with a second insert plug 19 of the vehicle 10.

Alternatively, in a variant of the non-illustrated self-propelled wrapping machine 1, in addition to the insert plugs 18, 19 for transmitting electric supply power, the interface system can comprise two wireless transmission units, for example in radio frequency, mounted on the vehicle and on the wrapping apparatus 2 and arranged to transmit and receive signals and data.

The unwinding unit 5 of the wrapping apparatus 2 comprises a film reel 50 and a roller assembly 13 arranged to unwind and/or pre-stretch the film while it is unwound around the load. More in detail, the roller assembly 13 can comprise a plurality of guiding rollers and a pair of powered pre-stretching rollers, i.e. driven in rotation by a motor around respective longitudinal axes so as to unwind and pre-stretch the film before it is wrapped around the load.

Alternatively, the unwinding unit 5 can comprise, instead of pre-stretching rollers, a steered roller capable of elongating or stretching the film while it is wrapped around the load.

The wrapping apparatus 2 comprises a moving system, of the known type and not illustrated, to move the unwinding unit 5 along the column 4 in both directions, i.e. rising and descending, typically at an alternating movement while wrapping the load.

In the illustrated embodiment of the self-propelled wrapping machine 1 of the invention, the wrapping apparatus 2 comprises an electric accumulator 8, for example formed by one or more batteries or cells, arranged to electrically power supply components and devices of the wrapping apparatus 2 and, in particular, the moving system of the unwinding unit 5, the first control unit 10 and the motor to actuate pre-stretching rollers, if provided in the unwinding unit 5.

A recharge plug, not illustrated, is provided on the wrapping apparatus 2 to enable connection with the power grid and recharge of the electric accumulator 8 when the wrapping apparatus 2 is separated from the vehicle 10 in the disassembled condition B of the self-propelled wrapping machine 1 and positioned in a parking area S of the place of use where a corresponding and complimentary recharge plug is present.

In this case, the interface system is merely used for transmitting signals and data between vehicle 10 and wrapping apparatus 2 and can comprise only wireless transmitting units, for example in radio frequency.

Alternatively, in one version of the self-propelled wrapping machine 1 of the invention, it is envisaged that the wrapping apparatus 2 is not provided with an accumulator and is power supplied by the vehicle 10. In such case, the interface system, comprising the insert plugs 18, 19, enables to power supply the wrapping apparatus 2.

The automatic guided vehicle 10 comprises an automatic navigation system, of the known type, for example a wire, magnets, optics, odometric, mixed (laser and odometric), laser, GPS drive system. Such a drive system enables the vehicle to follow a predefined wrapping path that is preset and programmed around the load or loads to be wrapped.

The operation of the self-propelled wrapping machine 1 of the invention has an initial coupling step in which the suitably programmed automatic movement vehicle 10 arrives at a parking area S of a place of use (factory premise, plant, warehouse) for connecting automatically to the wrapping apparatus 2 arranged therein. More precisely, the vehicle 10 inserts inside the seating 6 of the supporting base 3 of the wrapping apparatus 2, in particular moving along the operating direction T, and thus the platform 25 of the lifting system is vertically moved so as to abut the inner wall of the central portion 3*a* of the supporting base 3 and lift the wrapping apparatus 2 from the supporting plane 150 in the assembled condition A. During the lifting, the first connecting assembly or pins 15 that extend from the inner part of the central portion 3*a* insert in and engage with the second connecting assembly or openings 16 of the vehicle 10. Thereby, in the assembled condition A of the self-propelled wrapping machine 1 the wrapping apparatus 2 is tightly engaged to the vehicle 10 thanks to connecting assemblies 15, 16 which prevent possible sliding and relative displacements.

In the assembled condition A the self-propelled wrapping machine 1 is ready to be used. The vehicle 10 moves together with the wrapping apparatus 2 along a preset trajectory towards a load to be wrapped and once arrived it moves along a wrapping path around the aforesaid load. As the first control unit 20 of the wrapping apparatus 2 and the second control unit 21 of the vehicle 10 are connected and communicating by means of the interface system 18, 19, unwinding the film around the load can be carried out according to the displacement of the self-propelled wrapping machine 1 around the latter. More precisely, the first control unit 20 adjusts and controls the displacement of the unwinding unit 5 along the column 4 and the unwinding and possible pre-stretching of the film from the reel 50 based on data supplied by the second control unit 20 and related to position and displacement around the load of the vehicle 10 i.e. of the whole self-propelled wrapping machine 1. Thereby, the latter is capable of achieving a defined wrapping configuration F of the load.

Fixing an initial edge of the film to the load at the beginning of the wrapping and subsequently cutting the film at the end of the wrapping can be carried out manually by an operator or automatically by suitable cutting and welding elements provided on the self-propelled wrapping machine 1.

Once wrapping is finished, the self-propelled wrapping machine 1 can be directed to another load to be wrapped or taken back to the parking area S to enable the vehicle 10 to release the wrapping apparatus 2. To this end, the platform 25 of the lifting system is vertically moved downwards so as to move away from the inner wall of the central portion 3*a* of the supporting base 3 and thus lower the wrapping apparatus 2 until it contacts the supporting plane 150 by means of the supporting arrangement 7. While the platform 25 is lowered, the first connecting assembly or pins 15 disengage from the second connecting assembly or openings 16 of the vehicle 10. The vehicle 10 can thus disengage automatically from the seat 6 of the supporting base 3 in the disassembled condition B of the self-propelled wrapping machine 1.

The vehicle 10 can thus be employed in the place of use, for example a factory premise, to fulfil other functions, for example to move a carriage, a platform, a product, etcetera or to be used to move another wrapping apparatus 2 placed in another operative area of the factory premise to form a respective self-propelled wrapping machine 1.

Referring to FIGS. 5 to 8, a variant of the self-propelled wrapping machine 1 of the invention is illustrated which differs from the embodiment described above and illustrated in FIGS. 1 to 4 for the different type of automatic guided vehicle 11. In this variant, the automatic guided vehicle 11, of the type known as AGV "transpallet", is provided with two lifting forks and it is mainly used to move pallets.

In this case, the lifting system of the vehicle 11 comprises the two lifting forks 26 provided with the second connecting assembly 16 in the form of openings adapted to receive and be engaged by pins of first connecting assembly 15 of the wrapping apparatus 2.

The functioning of this version of the self-propelled wrapping machine 1 is the same as the previously described machine.

The invention also comprises a wrapping apparatus 2 which includes a supporting base 3, a column 4 fixed to the latter and an unwinding unit 5 slidingly supported by, and movable along, the column 4 and adapted to supply the plastic film unwound from a reel 50, the aforesaid wrapping apparatus 2 being reversibly and automatically coupled to an automatic guided vehicle or shuttle 10 in an assembled condition A and movable by the latter so as to form the wrapping machine 1 described above and illustrated in the figures. The wrapping apparatus 2 can also be reversibly and automatically uncoupled from the automatic guided vehicle 10 and hence separated from the latter in a disassembled condition B of the self-propelled wrapping machine 1.

The self-propelled wrapping machine 1 according to the invention is particularly cheap, efficient and easy to use, as it employs, in order to move around the load, a standard-type automatic guided vehicle or AGV 10, generally already available in industrial and production sites such as factories, deposit plants and in any case employable to carry out a plurality of additional and different tasks and functions. Thus, it is not necessary a specific carriage or cart integrated (i.e. not removable if not by completely disassembling the self-propelled wrapping machine) with the wrapping apparatus 2 to form the self-propelled wrapping machine 1, but any automatic guided vehicle 10, properly configured and programmed, is sufficient. The cost of the wrapping machine is thus significantly reduced.

It must be noted that the wrapping apparatus 2 of the invention, that can be positioned in a stationary manner in a parking area S of the production site when it is not used in a disassembled condition B of the self-propelled wrapping machine 1, in addition to its easy and cost-effective construction, enables to wrap the film evenly and regularly around loads even having different sizes and compositions. In particular, it is possible to implement a desired and pre-established wrapping configuration F of the load as the first control unit 20 of the wrapping apparatus 2 and the second control unit 21 of the vehicle 10 are connected and communicating by means of the interface system 18, 19 (via cable or wirelessly). Thereby unwinding the film around the load can be performed according to the displacement of the vehicle 10 i.e. of the whole self-propelled wrapping machine 1 around the latter.

The invention claimed is:

1. A self-propelled wrapping machine movable around a load to wrap the load with a film of plastic material, the self-propelled wrapping machine comprising:

a wrapping apparatus which includes a supporting base, a column fixed to said supporting base and an unwinding unit suitable to supply the film unwound from a reel and slidably supported by said column;

an automatic guided vehicle movable and arranged to be reversibly and automatically coupled to said supporting base in an assembled condition of said self-propelled wrapping machine to support and move said wrapping apparatus around the load and enable wrapping of the load with the film.

2. The self-propelled wrapping machine according to claim 1, wherein said automatic guided vehicle is arranged to automatically uncouple from said supporting base in a disassembled condition of said self-propelled wrapping machine wherein said automatic guided vehicle and said wrapping apparatus are uncoupled and separated.

3. The self-propelled wrapping machine according to claim 1, wherein said supporting base comprises a seating suitable for housing said automatic guided vehicle in said assembled condition.

4. The self-propelled wrapping machine according to claim 3, wherein said automatic guided vehicle is configured to be automatically inserted into, or removed from, said seating moving along an operating direction nearly parallel to a supporting plane on which said automatic guided vehicle rests and moves.

5. The self-propelled wrapping machine according to claim 1, wherein said supporting base comprises a supporting arrangement for abutting a supporting plane on which said automatic guided vehicle rests and moves, and for supporting said wrapping apparatus when said wrapping apparatus is uncoupled and separated from said automatic guided vehicle in a disassembled condition of said self-propelled wrapping machine.

6. The self-propelled wrapping machine according to claim 1, wherein said automatic guided vehicle comprises a lifting system for lifting said supporting base and said wrapping apparatus from a supporting plane on which said automatic guided vehicle rests and moves, in said assembled condition.

7. The self-propelled wrapping machine according to claim 1, further comprising connecting assemblies for attaching said wrapping apparatus to said automatic guided vehicle in said assembled condition.

8. The self-propelled wrapping machine according to claim 1, further comprising an interface system for connecting said wrapping apparatus and said automatic guided vehicle in said assembled condition and for allowing transmission of electrical signals and/or power supply.

9. The self-propelled wrapping machine according to claim 1, wherein said wrapping apparatus comprises at least one electric accumulator for power supply of said wrapping apparatus.

10. The self-propelled wrapping machine according to claim 1, wherein said wrapping apparatus comprises a moving system for moving said unwinding unit along said column, said unwinding unit comprising the reel of film and a roller assembly for unwinding and/or pre-stretching the film.

11. The self-propelled wrapping machine according to claim 1, wherein said wrapping apparatus comprises a first control unit for adjusting at least unwinding of the film around the load and said automatic guided vehicle comprises a second control unit for controlling and guiding said automatic guided vehicle at least around the load along a defined wrapping path.

12. The self-propelled wrapping machine according to claim 11, wherein said first control unit and said second control unit are connected and communicate with each other via an interface system in order to guide said automatic guided vehicle along the defined wrapping path and to control movement of said unwinding unit along said column and the unwinding of the film around the load so as to achieve a defined wrapping configuration.

13. The self-propelled wrapping machine according to claim 1, wherein said automatic guided vehicle comprises an automatic navigation system.

14. The self-propelled wrapping machine according to claim 1, wherein said automatic guided vehicle comprises one of a lowered automatic guided vehicle for towing carriages, or an automatic guided vehicle with lifting forks.

15. A wrapping apparatus comprising a supporting base, a column fixed to said supporting base and a unwinding unit slidably supported by, and movable along, said column and arranged to supply a plastic film to wrap a load, said wrapping apparatus being reversibly and automatically couplable to an automatic guided vehicle in an assembled condition and movable by the automatic guided vehicle so as to make a self-propelled wrapping machine according to claim 1.

* * * * *